US007726732B1

(12) United States Patent
Keating

(10) Patent No.: US 7,726,732 B1
(45) Date of Patent: Jun. 1, 2010

(54) CHAIR MOUNTABLE DESK APPARATUS

(76) Inventor: Sherrina J. Keating, 1807 Loch Ness Dr., Rawlins, WY (US) 82301

( * ) Notice: Subject to any disclaimer, the term of this patent is extended or adjusted under 35 U.S.C. 154(b) by 0 days.

(21) Appl. No.: 12/208,376

(22) Filed: Sep. 11, 2008

(51) Int. Cl.
*A47B 39/00* (2006.01)
*A47B 39/02* (2006.01)
*A47B 39/06* (2006.01)
*A47B 83/02* (2006.01)

(52) U.S. Cl. ..... 297/170; 297/160; 297/161; 297/162; 297/173

(58) Field of Classification Search ..... 297/160, 297/161, 162, 170, 173, 188.01, 188.14, 297/188.15, 188.21
See application file for complete search history.

(56) References Cited

U.S. PATENT DOCUMENTS

| | | | | | |
|---|---|---|---|---|---|
| 2,994,366 | A * | 8/1961 | Hoch | 297/162 X |
| D246,490 | S | 11/1977 | DuFresne | |
| 4,300,798 | A * | 11/1981 | Musgrove et al. | 297/162 X |
| 4,848,833 | A * | 7/1989 | Grall | 297/162 |
| 5,228,711 | A * | 7/1993 | Summers | 297/161 X |
| 5,653,499 | A * | 8/1997 | Goodall | 297/170 |
| 5,893,607 | A | 4/1999 | Trimnell | |
| 6,045,179 | A | 4/2000 | Harrison | |
| 6,145,926 | A * | 11/2000 | Lin | 297/170 X |
| 6,354,658 | B1 | 3/2002 | Sher et al. | |
| 6,425,631 | B1 * | 7/2002 | Lin | 297/170 X |
| 6,702,373 | B2 | 3/2004 | Rossko | |
| 6,722,681 | B1 * | 4/2004 | Large | 297/155 X |
| 6,755,137 | B2 * | 6/2004 | Wentz | 297/160 X |
| 6,773,060 | B2 | 8/2004 | Sher et al. | |
| 7,210,736 | B1 * | 5/2007 | Large | 297/160 X |
| 7,281,762 | B1 * | 10/2007 | Getfield | 297/173 |
| 7,311,354 | B2 * | 12/2007 | Giasson | 297/161 |
| 7,530,632 | B2 * | 5/2009 | Kaloustian et al. | 297/161 X |
| 7,568,760 | B1 * | 8/2009 | Lodes | 297/173 X |
| 2006/0192415 | A1 * | 8/2006 | Steenson | 297/161 |
| 2007/0131149 | A1 | 6/2007 | Mayben | |
| 2008/0073946 | A1 * | 3/2008 | Maione | 297/161 |

* cited by examiner

*Primary Examiner*—Rodney B White

(57) ABSTRACT

A chair mountable desk apparatus includes a clamp is removably positioned on an armrest. A first panel has a top side, a bottom side and a perimeter edge. The first panel is mechanically coupled to the clamp and a computer mouse is positionable on the top side. The first panel has a first lateral edge, a second lateral edge, a first end edge and a second end edge. A second panel has an upper surface, a lower surface, and a peripheral edge. A rod is attached to the lower surface and extends outwardly from the peripheral edge. A sleeve is attached to the bottom side of the first panel nearer to the first end edge than the second end edge. A keyboard is positionable on the upper surface. The sleeve receives the rod to position the second panel adjacent to the second lateral edge.

6 Claims, 4 Drawing Sheets

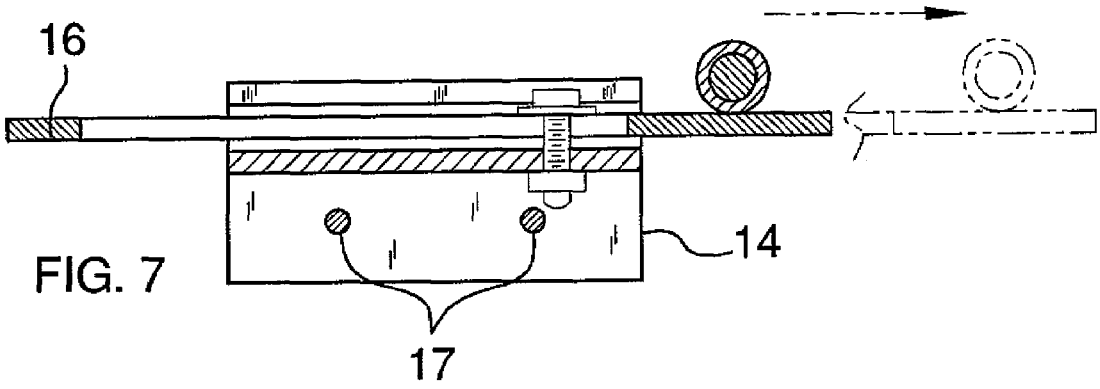
FIG. 7
FIG. 8
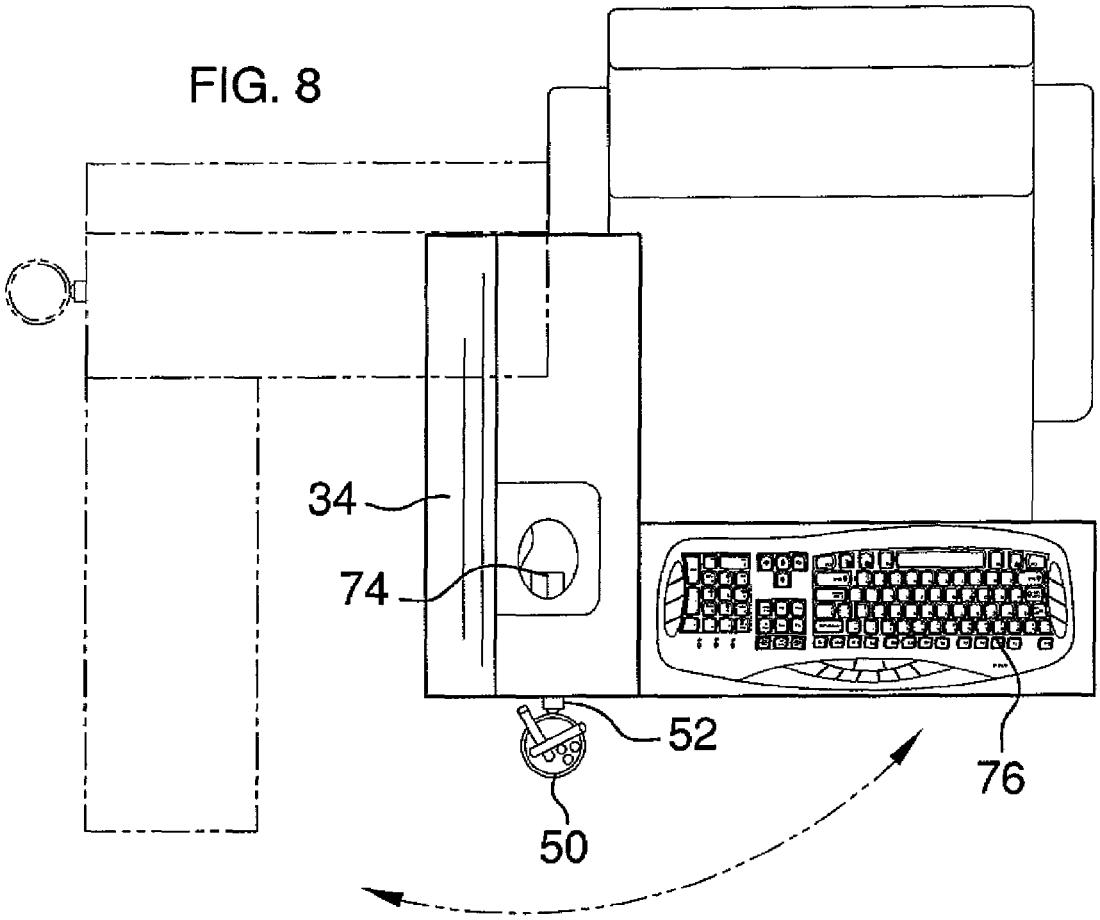

CHAIR MOUNTABLE DESK APPARATUS

BACKGROUND OF THE INVENTION

Field of the Invention

The present invention relates to chair mountable desk devices and more particularly pertains to a new chair mountable desk device for attaching to an armrest to provide a support surface for a computer mouse and a computer keyboard.

SUMMARY OF THE INVENTION

The present invention meets the needs presented above by generally comprising a clamp is removably positioned on an armrest. A first panel has a top side, a bottom side and a perimeter edge. The first panel is mechanically coupled to the clamp and a computer mouse is positionable on the top side. The first panel has a first lateral edge, a second lateral edge, a first end edge and a second end edge. A second panel has an upper surface, a lower surface, and a peripheral edge. A rod is attached to the lower surface and extends outwardly from the peripheral edge. A sleeve is attached to the bottom side of the first panel nearer to the first end edge than the second end edge. A keyboard is positionable on the upper surface. The sleeve receives the rod to position the second panel adjacent to the second lateral edge. The rod is rotational with respect to the sleeve to allow the second panel to be tilted with respect to the first panel. A locking fastener engages the sleeve to lock the rod at a selected position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a cross-sectional view taken along line 7-7 of FIG. 6 of the present invention.

FIG. 8 is a top in-use view of the present invention.

DESCRIPTION OF THE PREFERRED EMBODIMENT

Figure 1:
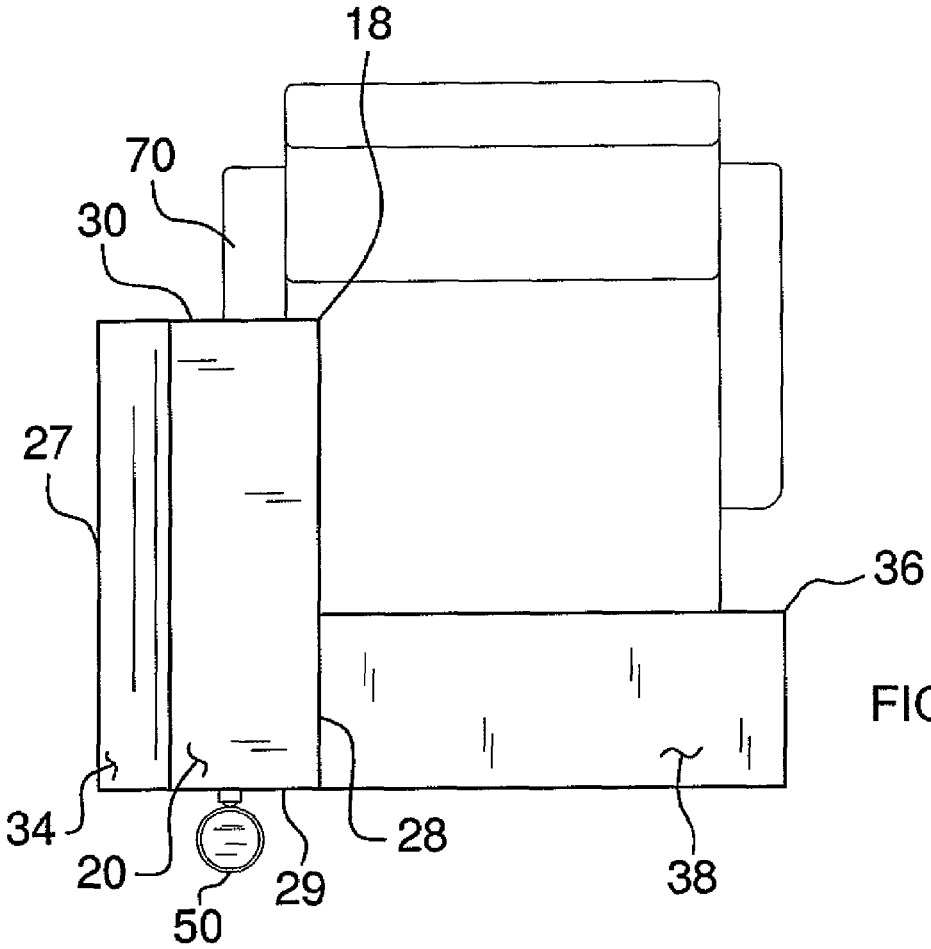
FIG. 1 is a top in-use view of a chair mountable desk apparatus according to the present invention.
Figure 2:
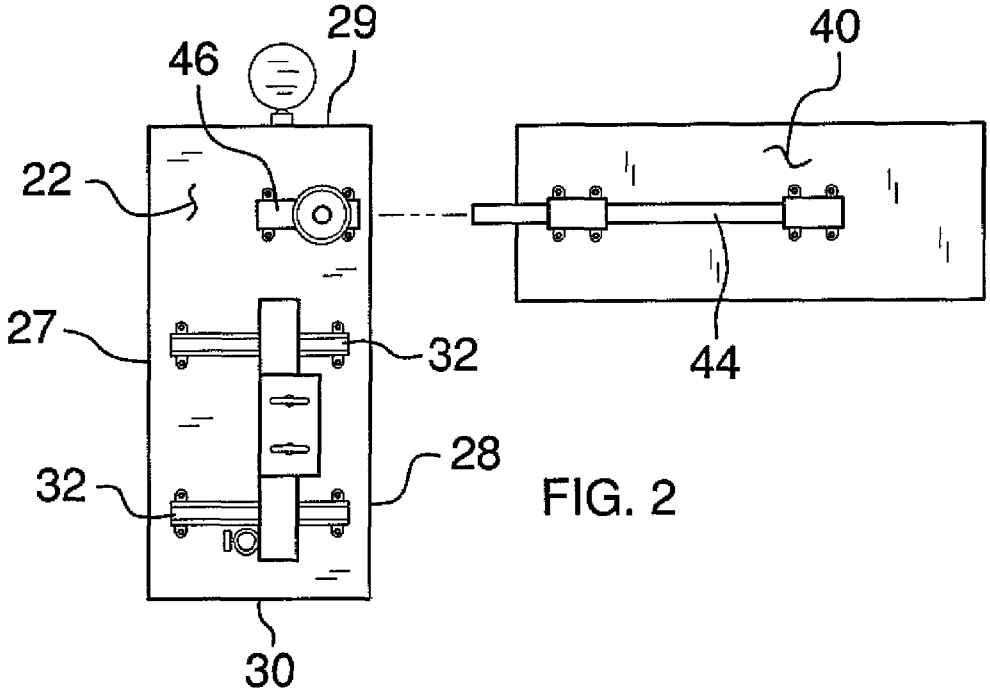
FIG. 2 is a bottom expanded view of the present invention.
Figure 3:
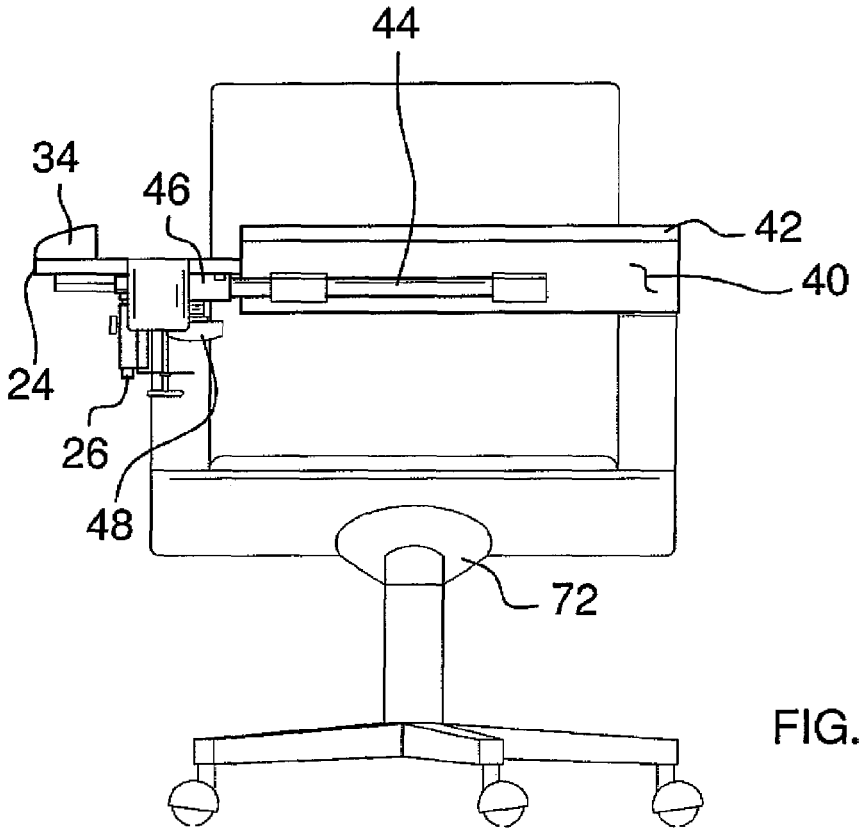
FIG. 3 is a front in-use view of the present invention.
Figure 4:
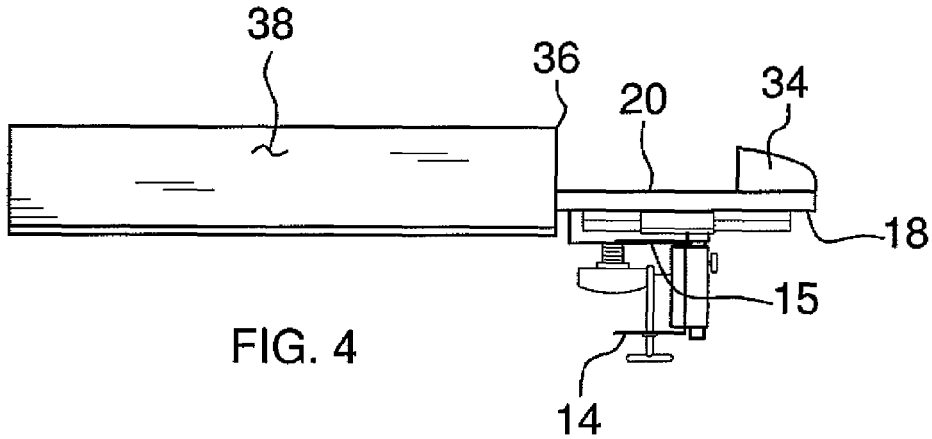
FIG. 4 is a rear view of the present invention.
Figure 5:
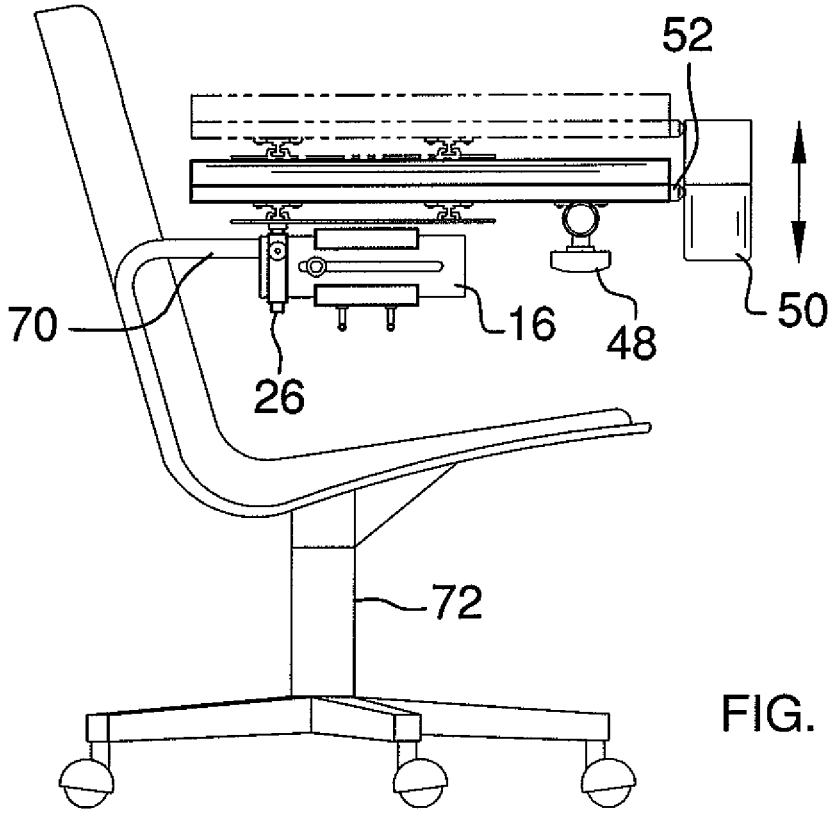
FIG. 5 is a right side view of the present invention.
Figure 6:
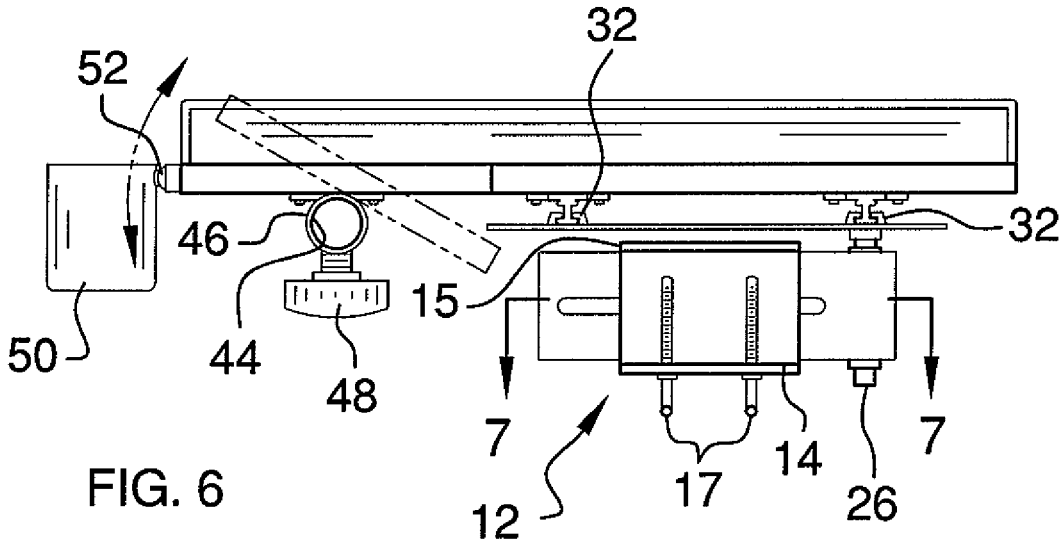
FIG. 6 is a left side view of the present invention.

With reference now to the drawings, and in particular to FIGS. 1 through 8 thereof, a new chair mountable desk device embodying the principles and concepts of the present invention and generally designated by the reference numeral 10 will be described.

As best illustrated in FIGS. 1 through 8, the chair mountable desk apparatus 10 generally comprises a clamp 12 that is removably positioned on an armrest 70 of a chair 72. The clamp 12 includes a pair of attached and spaced horizontal plates 14, 15 and the armrest 70 is positioned between the horizontal plates 14, 15. A pair of threaded posts 17 extends through one of the horizontal plates 14 and biases the armrest 70 against the other one of the horizontal plates 15. As is shown in FIG. 7, the horizontal plates 14, 15 are slidably coupled to a vertical plate 16 to allow the clamp 12 to be moved forward or rearward on the armrest 70.

A first panel 18 has a top side 20, a bottom side 22 and a perimeter edge 24. The first panel 18 is mechanically coupled to the clamp 12. A computer mouse 74 is positionable on the top side 20. The first panel 18 is positionable nearer or further from the armrest by way of a mount post 26 which pivotally attaches the first panel 18 to the clamp 12. The mount post 26 has a selectively adjustable height to move the first panel 18 upwardly or downwardly with respect to the clamp 12. The first panel 18 is pivotally coupled to the clamp 12 to allow the first panel 18 to be pivotable away from the chair. The first panel 12 has a first lateral edge 27, a second lateral edge 28, a first end edge 29 and a second end edge 30. The first panel 18 may be attached to the clamp 18 by way of rails 32 to allow the first panel 18 to slide toward or away from the chair 72.

A raised member 34 is attached to and extends along the top side 20 adjacent to the first lateral edge 27. The raised member 34 is comprised of a resiliently compressible material. The raised member 34 prevents the computer mouse 74 from falling off of the first panel 18 as well as serves as an armrest for a user of the apparatus 10.

A second panel 36 has an upper surface 38, a lower surface 40, and a peripheral edge 42. A rod 44 is attached to the lower surface 40 and extends outwardly from the peripheral edge 24. A sleeve 46 is attached to the bottom side 22 of the first panel 18 nearer to the first end edge 29 than the second end edge 30. A keyboard 76 is positionable on the upper surface 38. The sleeve 46 receives the rod 44 to position the second panel 36 adjacent to the second lateral edge 28. The rod 44 is rotational with respect to the sleeve 46 to allow the second panel 36 to be tilted with respect to the first panel 18. A locking fastener 48 engages the sleeve 46 to lock the rod 44 at a selected position.

A container 50 has a hinge member 52 attached to thereto. The hinge member 52 is coupled to the first end edge 29 of the first panel 18. The hinge member 52 allows the container 50 to be moved to a deployed position or a stored position. The container 50 is used for holding writing utensils or may be used for holding drink containers.

In use, the first panel 18 is attached to the armrest 70 by way of the clamp 12 as is shown in the Figures and as described above. The second panel 36 is attached to the first panel 18 with the rod 44 and the sleeve 46 and the second panel 36 may be titled as needed for comfort of the user of the apparatus 10 while typing. The first 18 and second 36 panels may each be pivoted away from the chair 72, as needed to sit in or remove oneself from the chair 72.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chair mountable desk apparatus, said apparatus being removably positionable on an armrest of a chair, said apparatus comprising:

a clamp being adapted to be removably positioned on the armrest;

a first panel having a top side, a bottom side and a perimeter edge, said first panel being mechanically coupled to said clamp, wherein a computer mouse is adapted to be positionable on said top side, said first panel having a first lateral edge, a second lateral edge, a first end edge and a second end edge;

a second panel having an upper surface, a lower surface, and a peripheral edge, a rod being attached to said lower surface and extending outwardly from said peripheral edge;

a sleeve being attached to said bottom side of said first panel nearer to said first end edge than said second end edge, wherein a keyboard is adapted to be positionable on said upper surface, said sleeve receiving said rod to position said second panel adjacent to said second lateral edge, said rod being rotational with respect to said sleeve to allow said second panel to be tilted with respect to said first panel;

a locking fastener engaging said sleeve to lock said rod at a selected position; and a raised member being attached to and extending along said top side adjacent to said first lateral edge.

2. The apparatus according to claim 1, wherein said first panel is positionable nearer or further from the armrest.

3. The apparatus according to claim 2, wherein said first panel is pivotally coupled to said clamp to allow said first panel to be pivotable away from the chair.

4. The apparatus according to claim 1, wherein said raised member is comprised of a resiliently compressible material.

5. The apparatus according to claim 1, further including a container having a hinge member attached to thereto, said hinge member being coupled to said first panel.

6. A chair mountable desk apparatus, said apparatus being removably positionable on an armrest of a chair, said apparatus comprising:

a clamp being adapted to be removably positioned on the armrest;

a first panel having a top side, a bottom side and a perimeter edge, said first panel being mechanically coupled to said clamp, wherein a computer mouse is adapted to be positionable on said top side, said first panel being positionable nearer or further from the armrest, said first panel being pivotally coupled to said clamp to allow said first panel to be pivotable away from the chair, said first panel having a first lateral edge, a second lateral edge, a first end edge and a second end edge;

a raised member being attached to and extending along said top side adjacent to said first lateral edge, said raised member being comprised of a resiliently compressible material;

a second panel having an upper surface, a lower surface, and a peripheral edge, a rod being attached to said lower surface and extending outwardly from said peripheral edge;

a sleeve being attached to said bottom side of said first panel nearer to said first end edge than said second end edge, wherein a keyboard is adapted to be positionable on said upper surface, said sleeve receiving said rod to position said second panel adjacent to said second lateral edge, said rod being rotational with respect to said sleeve to allow said second panel to be tilted with respect to said first panel;

a locking fastener engaging said sleeve to lock said rod at a selected position; and a container having a hinge member attached to thereto, said hinge member being coupled to said first end edge of said first panel.

* * * * *